United States Patent [19]

Whittenberg

[11] 4,018,011

[45] Apr. 19, 1977

[54] CENTERLESS GRINDER WORK SUPPORT AND BOOTY ROLLER THEREFOR

[76] Inventor: George R. Whittenberg, 11860 Freud Ave., Detroit, Mich. 48214

[22] Filed: May 12, 1975

[21] Appl. No.: 576,554

[52] U.S. Cl. ..... 51/236; 51/103 TF; 214/339

[51] Int. Cl.[2] ..... B24B 41/06

[58] Field of Search ..... 214/1 R, 339; 198/127 R; 51/236, 103 WH, 103 TF; 29/DIG. 23; 16/18 A

[56] References Cited

UNITED STATES PATENTS

| | | | |
|---|---|---|---|
| 912,010 | 2/1909 | Martin | 16/18 A |
| 2,096,239 | 10/1937 | Geyer | 16/18 A |
| 2,165,097 | 7/1939 | Fuller | 51/236 X |
| 2,720,119 | 10/1955 | Sherman | 29/DIG. 23 |
| 2,775,077 | 12/1956 | Whittenberg | 51/236 |
| 2,949,189 | 8/1960 | Haines | 198/127 R X |
| 3,091,900 | 6/1963 | Wittenberg | 51/236 |
| 3,135,406 | 6/1964 | Skarstrom | 214/339 |

*Primary Examiner*—Harold D. Whitehead
*Attorney, Agent, or Firm*—Burton, Parker & Schramm

[57] ABSTRACT

A work support for a centerless grinder or the like comprises an elongated floor-supported guide tube adapted to extend along beneath a work piece to be machined in the grinder with a plurality of V-shaped supports arranged on the guide tube in spaced relation therealong and having at their ends a pair of work supporting booty rollers mounted in confronting cooperative work supporting relation on opposite sides of the work to be supported with the axes of the rollers skewed to the axis of the work, each such roller having a booty axle having angularly related roller receiving and axle mounting portions with the latter supported on the V-shaped arms to extend parallel to the axis of the work to be supported, and with means supporting the axle mounting portion on the arms for adjustable rotation about their axes and for locking the axles in adjusted rotated positions, thereby providing for adjustment of the skew angle of the booty rollers relative to the work to be supported.

3 Claims, 7 Drawing Figures

4
W
B
53
52
30
25
34
32
27
36
4
28
24

26
54
44
53
52
40
60
28
30
32
C
27
44
46
54
W
53
52
40
26
60
42
34
34

W
26
50
52
53
26
54

58
56
32
30
28
34
27
36

CENTERLESS GRINDER WORK SUPPORT AND BOOTY ROLLER THEREFOR

FIELD OF INVENTION

This invention relates to work supports for centerless grinders, in particular a support which extends away from the grinder on opposite sides thereof for supporting elongated work pieces to be fed into and out of the grinder for machining operations by the grinder. The work piece supports hold the work piece in proper alignment with the support blade and in turn the grinding and regulating wheels of the grinder. The supports include rollers, herein called booty rollers, which are freely rotating and support the work piece for the rotation and translation in opposite directions of movement toward and from the grinder.

BACKGROUND OF THE INVENTION

In my prior U.S. Pat. Nos. 2,775,077, 3,019,571 and 3,091,900 I have disclosed apparatus of the general type to which my instant invention relates. Such apparatus is accessory to centerless grinding machines or the like and comprises a floor-supported guide tube on which are arranged in spaced apart relation therealong a plurality of upwardly extending V-shaped supports with the arms of the V disposed on opposite sides of the work piece to be machined by the grinder. Booty rollers having their axes of rotation skewed to the axis of the work piece are mounted in opposed cooperating work piece supporting relation on the arms. The booty rollers are freely rotating and as the work piece is rotated in the grinder by the regulating wheel, the booty rollers support the work piece for free rotation in proper alignment with the support blade of the grinder.

It is conventional within a centerless grinder to provide a regulating wheel whose axis of rotation is adjustable relative to the axis of the work piece to be machined such that as the regulating wheel rotates in one direction it causes the work piece to rotate and at the same time translates it axially through the grinder causing the work piece to brush in grinding or polishing relation the periphery of the grinding wheel. The angular relation of the axis of the regulating wheel to the axis of the work piece is conventionally referred to as the "helix" angle of the regulating wheel. The skewed relation of the booty rollers to the axis of the work piece is intended to assist translation of the work piece through the centerless grinder.

I have found that difficulty has been encountered in satisfactorily grinding elongated work pieces following the teaching of the prior art. On occasion the work piece, particularly heavy work pieces, seem to have a tendency to stall in the grinder between the regulating wheel and the grinding wheel causing the grinder to grind a flat or dwell mark in the work piece often ruining the same. In addition, I have observed that the speed of translation of work pieces supported by prior art type work supports is not always uniform in passing through the centerless grinder and in consequence causes difficulty in reaching the desired dimension of the work piece during the grinding operation throughout the length of the work piece. In other words, as the amount of material removed from the work piece is dependent upon the exposure of the work piece to the grinding wheel, variations in the translation speed will result in variations in the amount of material removed from the work piece as it passes by the grinding wheel.

I have discovered that the aforementioned stalling as well as the variation in feed or translation rate of the work piece arises from the fact that when the operator varies the helix angle of the regulating wheel, such that the same does not correspond exactly to the skew angle of the booty rollers, the regulating wheel and booty rollers tend to "fight"; the one tending to speed up the translational movement of the work piece while the other tending to slow down the translational movement of the work piece with the result that either the regulating wheel or booty rollers will from time to time predominate in the determination of feed rate. This condition arises, in my opinion, from the fact that as an elongated work piece is being fed into the centerless grinder, a large number of booty rollers will be in supporting relation with the work piece and as the work piece enters the grinder and moves through it, fewer numbers of booty rollers will support the work piece and as a consequence, the skew angle thereof will be less predominant in determining translational rate than the helix angle of the regulating wheel. As the work piece passes through the centerless grinder and is supported by booty rollers on the outfeed side, as more and more of these rollers come in to supporting contact with the work piece the skew angle of the rollers will tend to more and more influence the translational rate of the work piece in relation to the translational rate as determined by the regulating wheel. Accordingly, varying translational rates may arise during movement of a work piece through the centerless grinder.

In severe cases the work piece may actually stall or dwell in the grinder with the concomitant result that a flat or dwell mark appears on the work piece as aforesaid. This may result from the skew angle of the booty rollers sufficiently resisting translation of the work piece so that translational movement is actually arrested in the grinder.

SUMMARY OF THE INVENTION

I have discovered that the aforesaid difficulties can be obviated by providing booty rollers whose skew angle can be adjusted so that it corresponds to the helix angle of the regulating wheel. Accordingly, the operator of the centerless grinder, upon adjusting the feed rate by adjusting the helix angle of the regulating wheel, can then, by adjusting the skew angle of the booty rollers, make the latter correspond, or substantially correspond, to the helix angle of the regulating wheel so that the aforesaid "fighting" therebetween is overcome and as a consequence the feed rate of the work piece is uniform from end to end through the grinder insuring uniform machining throughout its length and avoiding any tendency to stall or dwell within the grinder.

In the conventional centerless grinder the regulating wheel helix angle is variable between one and four degrees relative to the axis of the work piece being ground. Accordingly, according to my invention, the booty rollers are supported on the V-shaped support arms for adjustment of their skew angle between one and four degrees relative to the axis of the work piece to be supported. In carrying out the invention, the booty rollers have an axle with a roller receiving portion and an axle mounting portion which are arranged in end-to-end angled relation with the axes of the respective portions intersecting at a four degree angle. The axle supporting portion is adapted to be mounted on the arms of the V-shaped supports to extend parallel to the axis of the work piece. By adjustably rotating the axle, the helix angle component of the skew angle of the booty roller can be varied up to four degrees in relation to the axis of the work piece and thereby made to correspond to the helix angle of the regulating wheel, it only being necessary for the operator to individually adjust the axles of the booty wheels upon making an adjustment in the helix angle of the regulating wheel.

While the booty rollers may be provided with a steel work piece supporting surface, I have found that in many instances it is desirable to provide a booty roller with an elastomeric work piece supporting surface, such as a polyurethane elastomer. Difficulty has been encountered, however, in that using such elastomeric booty rollers with heavy work pieces has a tendency to cause the elastomeric material to be dislodged from the booty roller assembly because of the substantial axial forces and the compression and expansion of the elastomeric material as the roller revolves in its support of the work piece. I have discovered that this difficulty can be overcome by mechanically interlocking the elastomeric material to the booty roller assembly by casting such material in situ on a knurled exterior surface of an internal bushing within the booty roller. This bushing in turn may be supported on a roller bearing assembly which in turn supports the booty roller on the booty roller receiving portion of the axle.

BRIEF DESCRIPTION OF PREFERRED EMBODIMENT

Figure 1:
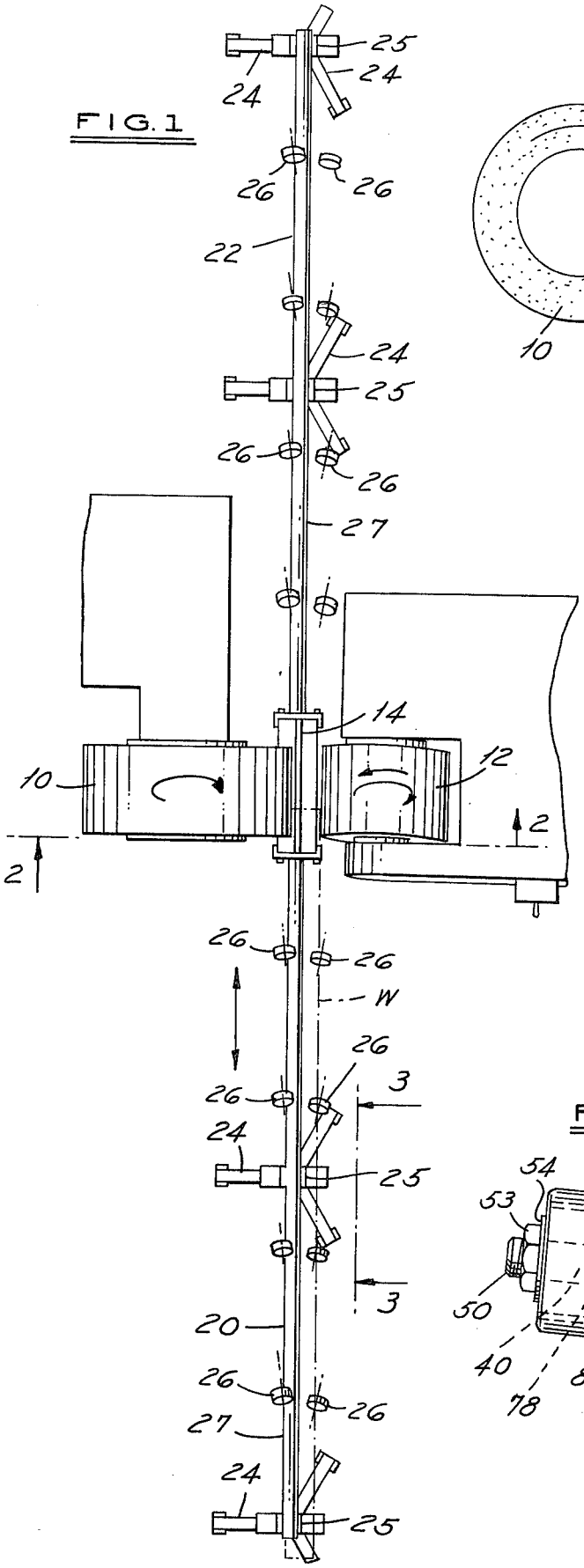
FIG. 1 is a plan view showing my work piece supporting fixtures extending from opposite sides of a centerless grinder.
Figure 2:
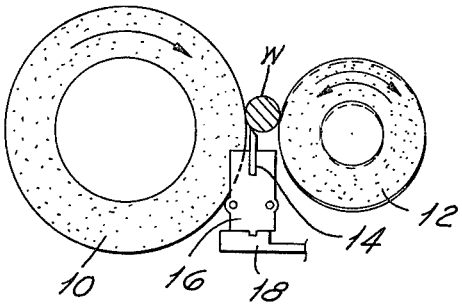
FIG. 2 is a cross sectional view taken substantially on the line 2—2 of FIG. 1.

A centerless grinding machine, such as a Cincinnati No. 3 Centerless Grinder manufactured by the Cincinnati Milling Machine Co. is schematically shown in FIGS. 1 and 2 and includes a grinding wheel 10 and a regulating wheel 12 between which is disposed the work piece supporting blade 14 which is carried by a work rest 16. The work rest is bolted in position on a slide 18 forming part of the centerless grinder.

As is conventional in a centerless grinder, the regulating wheel 12 is supported for movement toward and away from the grinding wheel 10 and also for swiveling action in a vertical plane to vary its helix angle with respect to the work piece being ground. This helix angle may be adjusted to lie anywhere between 0° and 7°, with the greater the angle the faster and feed rate of the work through the grinder and vice versa. In addition, the regulating wheel's direction of rotation is reversible as indicated by the arrows in FIG. 1. As a consequence, with the wheel rotating in one direction the work will be fed through the grinder from one side to the other and then by reversing the rotation of the regulating wheel the work can be fed back through the grinder.

Figure 3:
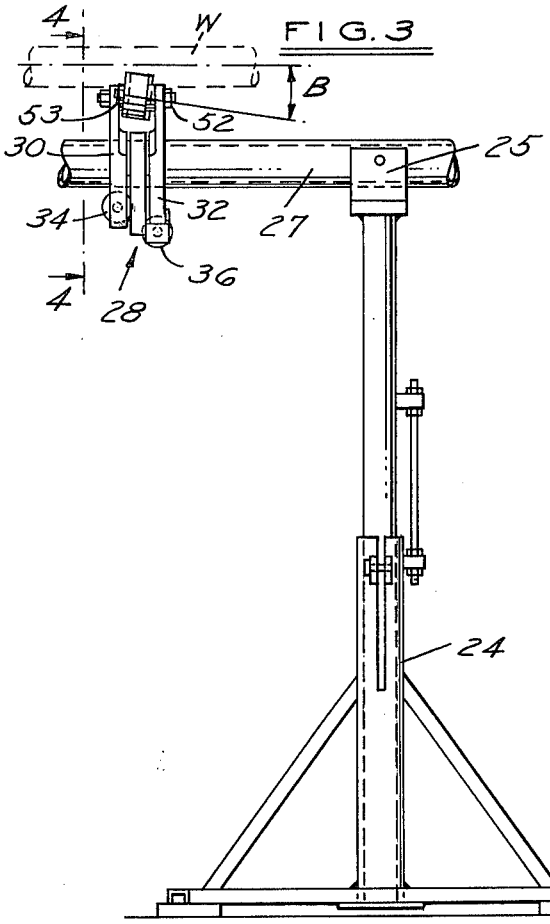
FIG. 3 is a vertical elevation taken on the line 3—3 of FIG. 1.

When grinding relatively long work pieces it is necessary to support the work on opposite sides of the grinder and such supporting fixtures are shown in FIG. 1 extending from opposite sides of the centerless grinder. In my U.S. Pat. No. 3,091,900I have shown and described in detail the arrangement of such fixtures and reference should be had thereto for a complete description. Suffice it to say that in FIG. 1 an infeed supporting fixture is shown at 20 and an outfeed fixture at 22. Each fixture is supported by a plurality of standards 24 one of which is shown in FIG. 3. At the upper end of each standard there is a cradle 25 for receiving and supporting an elongated guide tube 27. Arranged in spaced relation and supported on the guide tube are a plurality of transversely disposed V-shaped work piece supports provided with opposed, cooperating work supporting booty rollers 26. One of the V-shaped supports is shown in an end view in FIG. 4 and generally indicated at 28. While its construction and operation is more fully described in my aforesaid U.S. Pat. No. 3,091,900, in general the support comprises a pair of upwardly outwardly extending arms 30 and 32 mounted on the guide tube 27. The angular relationship between the arms 30 and 32 is adjustable by the manually operable hand screws 34 and 36 which are threaded through portions of the V-shaped assembly as more particularly described in my 900 patent to effect variation in the included angle A between the arms. Such adjustment provides for accommodating varying diameters of work pieces W and also for making small adjustments in the height of the work piece relative to the centerless grinder thereby providing for accurate alignment of the work piece with the supporting blade 14.

Figure 6:
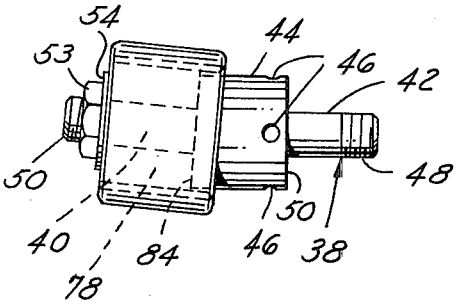
FIG. 6 is a side elevation of a booty roller assembly.
Figure 5:
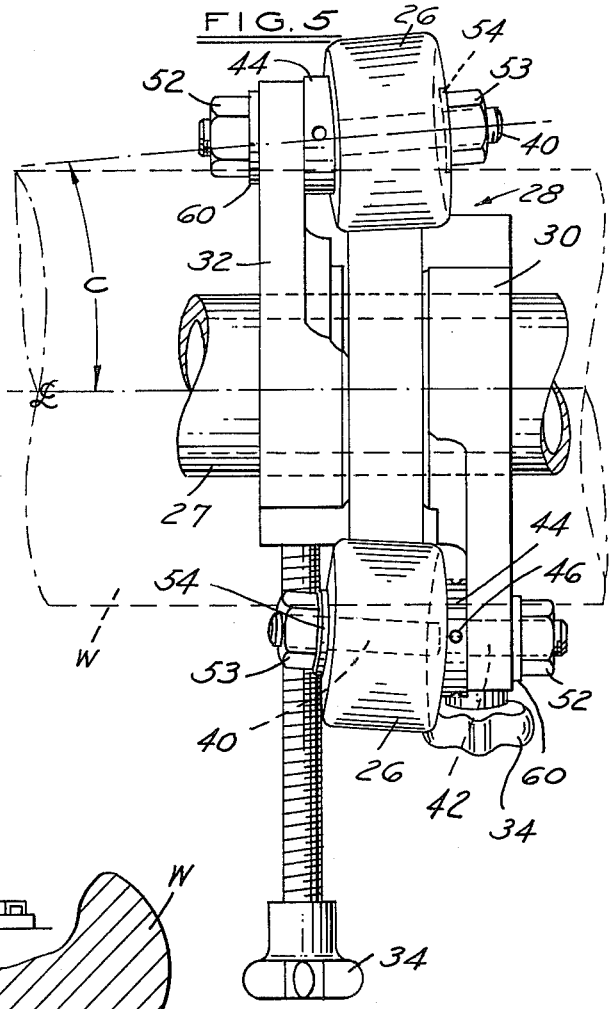
FIG. 5 is a plan view of the V-shaped support of FIG. 4.
Figure 4:
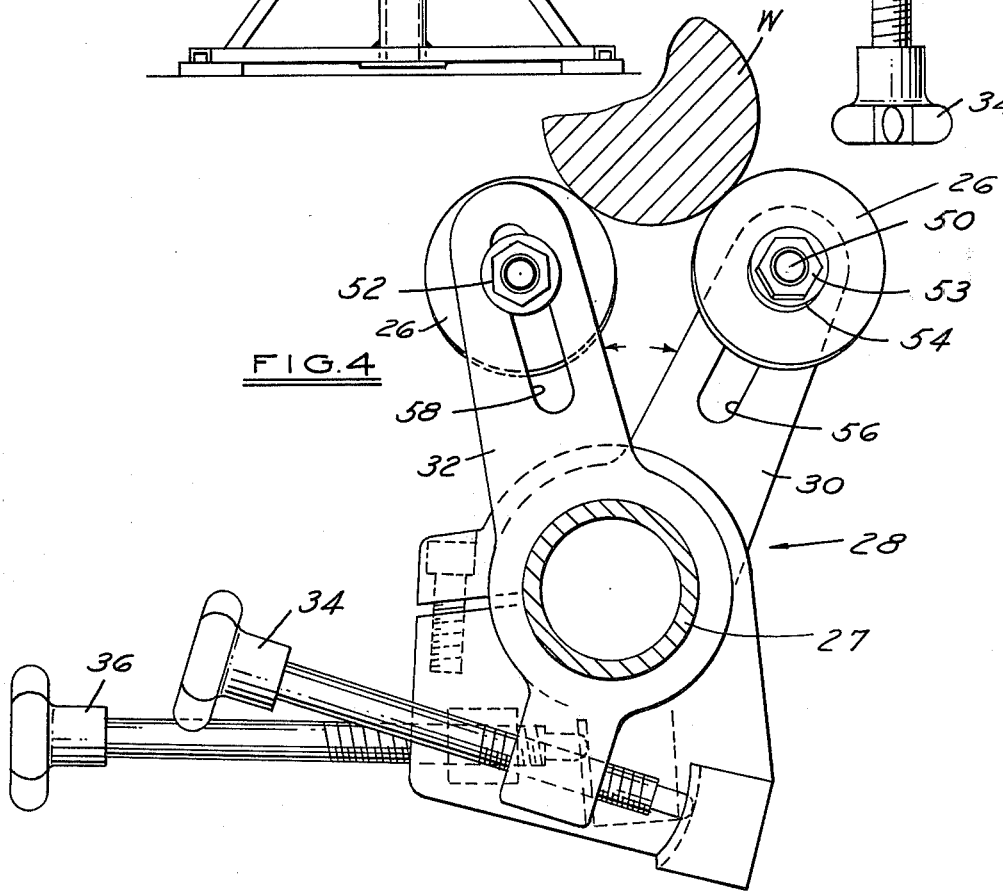
FIG. 4 is a cross sectional view taken on the line 4—4 of FIG. 3 but showing a work piece supported by the booty rollers.

The foregoing is all conventional in the centerless grinder art and serves as background for my invention now to be described. Each of the V-shaped supports is provided with a pair of work supporting booty rollers 26 mounted in confronting cooperative work supporting relation on the arms. Each of the booty rollers is provided as shown in FIG. 6 with an axle 38 which includes a booty roller receiving portion 40 and an axle mounting portion 42 arranged in end-to-end angled relation with the angle therebetween on the order of four degrees. At the intersection of the axle mounting portion and the booty roller receiving portion there is a radially extending shoulder 44 having wrench engaging means thereon, which in the embodiment shown comprises four radially extending spanner wrench receiving sockets 46. The axle mounting portion and the booty roller receiving portion are of cylindrical configuration with the former being threaded at its end 48 in spaced relation from the radially extending shoulder face 50 for reception of a locking nut 52 as shown in FIGS. 4 and 5. Means are provided at the end of the booty roller receiving portion opposite shoulder 44 for retaining the booty roller thereon. Such means comprise an externally threaded length 50 on the booty roller receiving portion with a nut 53 threaded thereon and bearing against a washer 54 which in turn overlies the end of the booty roller, roller bearing assembly 78.

Each of the arms 30 and 32 is provided with an elongate aperture 56 and 58 through which the axle mounting portion 42 of the axle 38 is received with the face 50 of the radial shoulder 44 overlying the arm adjacent the aperture and with the nut 52 bearing against a washer 60 for clamping the shoulder 44 tightly against the arm in any desired rotated position of the axle. As the plane of the V-shaped supports extends perpendicular to the axis of the work piece W and as the face 50 of the shoulder is perpendicular to the axis of the axle mounting portion 42, when the face 50 is tightened against the arms 30 and 32, the axis of the axle mounting portion will extend parallel to the axis of the work piece W. Consequently, by adjustably rotating the axle 38 relative to the supporting arm 30 and 32 prior to tightening the nut 52, the skew angle of the booty roller relative to the axis of the work piece can be adjusted. This skew angle is composed of two components, one lying in a vertical and the other in a horizontal plane relative to the axis of the work as shown by the angles B and C respectively in FIGS. 3 and 5, and in this respect differs from the helix angle of the regulating wheel. The axis of the regulating wheel lies in a vertical plane extending parallel to the axis of the work piece but horizontally displaced from the axis of the work. The resultant angle of angles B and C illustrated in FIGS. 3 and 5 is herein referred to as the skew angle. With a booty roller mounted on a supporting arm with its axle being in the position shown in FIG. 6, namely with the four degree angle between the axes of the axle supporting portion and the booty roller receiving portion lying in a vertical plane, angle C shown in FIG. 5 will be zero while angle B of FIG. 3 will be 4°. As the axle is rotatably adjusted, angle C will increase to a maximum of four degrees while angle B will be reduced from four degrees to zero. At intermediate points, angle B, which represents the helix angle of the booty roller in relation to the work piece, may be made to correspond to the helix angle of the regulating wheel by suitable rotatable adjustment of the booty axle on the support.

In setting up the booty rollers preparatory to grinding or polishing a work piece W in the centerless grinder, the operator will adjust the rotated position of the booty axles so that the angle B closely corresponds with the helix angle of the regulating wheel. Such adjustment is facilitated by the location of the spanner wrench receiving sockets 44. In the preferred arrangement, the sockets are disposed at 90° of rotation the helix angle B of the roller is adjusted by one degree. In other words the sockets provide an indicating means on the shoulder with the angular distance between the sockets corresponding to a predetermined increment of the angle between the portions 40 and 42 of the axle. As a consequence, by reference to the position of the sockets, the operator can adjust the booty roller from zero to four degrees helix angle with respect to the axis of the work piece and thereby have such angle correspond to the helix angle of the regulating wheel between zero degrees and four degrees. Such wrench engaging sockets also facilitate holding the axle in rotatably adjusted positions while tightening the nut 52.

Figure 7:
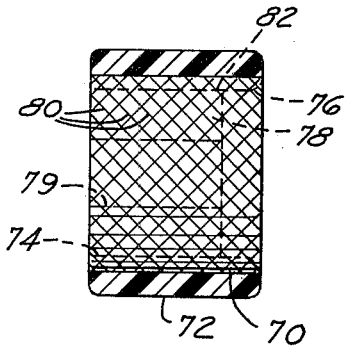
FIG. 7 is a side elevation of a booty roller bushing with an elastomeric surface shown in section.

In a preferred embodiment the booty roller is provided with an elastomeric work piece supporting surface to prevent marring or scratching of the work piece. Heretofore I have experimented with booty rollers having such elastomeric work supporting surfaces. However, the difficulty has been that there is a tendency of the elastomeric cover to be displaced axially and dislodged from its position on the booty roller assembly. I believe this has resulted from the squeezing and expansion of the elastomer as well as the heavy weight of the work piece as the roller rotates while at the same time the skew angle of the roller tends to axially displace the elastomer. I have discovered that this can be obviated by the construction herein shown. In FIG. 7 the booty roller is provided with a cylindrical bushing 70 of rigid material such as steel coaxial with the work piece supporting periphery 72 of the roller. The bushing has an inside diameter 74 which is desirably chamfered at 76 at one end. This inside diameter is finished smooth for a press fit over the roller bearing assembly 78 shown in FIG. 6 which is of conventional construction. The chamfered entrance 76 of the ID of the bushing allows the ready press fitting of the bushing over the roller bearing assembly. The roller bearing assembly has an inside bore 79 for reception over the booty roller receiving axle portion 40. The outside surface of the bushing is roughened as by knurling the same as indicated at 80. In manufacturing the booty roller the bushing with the knurled surface 80 is placed in a cylindrical mold concentric with the circular wall of the mold and then a urethane rubber or elastomer such a polyurethane in liquid form is poured into the mold to fill the same and contact the knurled surface 80 of the bushing. The mold is then placed in an oven and the liquid urethane cured to the solid state. Upon curing, the urethane will have entered the interstices of the knurled surface 80 mechanically interlocking the urethane to the bushing 70 and preventing any relative axial displacement of the urethane from the bushing.

In FIG. 7 the elastomer or urethane is shown in section phantom outline at 82. When mounting the booty roller on the booty roller receiving portion 40 of the axle, the shoulder 44 and its beveled face 84 (beveled at an angle corresponding to the four degree inclination between the opposite end portions of the axle) will enter the end of the bushing to bear lightly against the roller bearing assembly 78 as shown in FIG. 7 while the nut 53 will overlie the opposite end and the bearing assembly and bear against the intermediate washer or the like 54 as above mentioned.

During operation of the centerless grinder the regulating wheel 12 will engage the work and rotate the same depending upon the direction of rotation of the regulating wheel and cause a translation or axial movement of the work piece through the grinder. With the helix angle of the regulating wheel closely corresponding to the B angle component of the skew angle of the booty rollers, the booty rollers will assist in the translational movement of the work piece. After the work piece has passed through the grinder, the operator may reverse the direction of regulating wheel rotation and feed the work piece back through the grinder, such opposite rotational movement of the regulating wheel causing translation of the work in the opposite direction. With the work piece rotating in the opposite direction the booty rollers will of course revolve in the opposite direction again assisting the regulating wheel in uniformly feeding the work through the grinder. As a consequence of this arrangement there is no "fighting" between the action of the booty rollers and that of the regulating wheel and no tendency of the work piece to stall in the grinder ruining the same as has occurred with the prior art fixtures.

What is claimed is:

1. In a centerless grinder work support having an elongated floor supported guide tube adapted to extend along beneath a work piece to be machined in the grinder and with a plurality of upwardly extending V-shaped supports arranged on the guide tube in spaced relation therealong with the arms of the V disposed on opposite sides of the work to be supported, a pair of work supporting booty rollers mounted in confronting cooperative work supporting relation on the arms of each V-shaped support with the axes of the rollers skewed to the axis of the work to be supported, an axle for each booty roller, said axle comprising integral opposite end portions, one being a booty roller receiving portion and the other an axle mounting portion, said portions being arranged in end-to-end angled relation, and means supporting said axle mounting portions for adjustable rotation on the arms of the V-shaped supports about axes extending parallel to the axis of the work to be supported and for locking said axle mounting portions in fixed positions on such arms, whereby the skew angle of the booty roller receiving portion may be adjustably fixed relative to the work to be supported.

2. The invention defined by claim 1 characterized in that said means includes an aperture extending through each arm of the V-shaped supports through which the axle mounting portion is extended, said axle mounting portion includes a shoulder adapted to overlie one side of the arm of the V-shaped support adjacent said aperture and nut means threadedly engaged on the axle mounting portion for tightening against the opposite side of the arm adjacent the aperture.

3. The invention defined by claim 2 characterized in that said shoulder has wrench engaging means adapted to permit holding of the axle mounting portion in a fixed rotated position during tightening of said nut means.

* * * * *